US009702663B2

(12) United States Patent
Rabec Le Gloahec

(10) Patent No.: US 9,702,663 B2
(45) Date of Patent: Jul. 11, 2017

(54) SET FOR POSITIONING AND ALIGNING A DISRUPTOR FOR THE DEACTIVATION OF A TARGET

(71) Applicant: Commissariat A L'Energie Atomique et Aux Energies Alternatives, Paris (FR)

(72) Inventor: Marc Rabec Le Gloahec, Saint-Maurice-Montcouronne (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/046,593

(22) Filed: Feb. 18, 2016

(65) Prior Publication Data

US 2016/0161219 A1 Jun. 9, 2016

Related U.S. Application Data

(62) Division of application No. 14/053,998, filed on Oct. 15, 2013, now Pat. No. 9,291,428.

(30) Foreign Application Priority Data

Oct. 16, 2012 (FR) ..... 12 59865

(51) Int. Cl.
*F41G 3/00* (2006.01)
*F41G 3/14* (2006.01)
(Continued)

(52) U.S. Cl.
CPC ..... *F41G 3/145* (2013.01); *F41G 3/00* (2013.01); *F41G 3/323* (2013.01); *F41H 11/12* (2013.01);
(Continued)

(58) Field of Classification Search
CPC . F41G 3/326; F41G 3/323; F41G 3/00; F41G 1/54; F41G 1/00; Y10S 33/21; G01C 15/004
(Continued)

(56) References Cited

U.S. PATENT DOCUMENTS 4,777,754 A 10/1988 Reynolds, Jr.
4,879,814 A 11/1989 Wallace et al.
(Continued)

FOREIGN PATENT DOCUMENTS

EP 0 469 665 A1 2/1992
GB 2 224 102 A 4/1990

OTHER PUBLICATIONS

Search Report from French Application No. 1259865, date Aug. 23, 2013, 2 pages.

*Primary Examiner* — Benjamin P Lee
(74) *Attorney, Agent, or Firm* — Brinks Gilson & Lione

(57) ABSTRACT

A set for dismantling a target includes a disruptor having a firing axis and a device for aligning and positioning the disruptor in a deactivation direction relative to the target. A firing sub-set includes a movable mounting having a movable carriage mounted thereon to which the disruptor is fastened and provided with components for adjustment translation and orientation relative to the mounting. A mirror is oriented rearward of the disruptor and fastened to the disruptor perpendicular to the firing axis and having a centering mark centered on that axis. A pointing sub-set includes a laser mounted thereto and adapted to emit beams along an aiming line coaxial with the deactivation direction. The pointing sub-set is behind the firing sub-set relative to a target such that the mirror intercepts the laser aiming line at its centering mark and the disrupter firing axis is coaxial with the laser aiming line.

12 Claims, 4 Drawing Sheets

(51) Int. Cl.

| | |
|---|---|
| ***F42B 33/06*** | (2006.01) |
| ***F42D 5/04*** | (2006.01) |
| ***F41G 3/32*** | (2006.01) |
| ***F41H 11/12*** | (2011.01) |
| ***F41H 13/00*** | (2006.01) |

(52) U.S. Cl.
CPC ..... *F41H 13/005* (2013.01); *F42B 33/06* (2013.01); *F42B 33/065* (2013.01); *F42D 5/04* (2013.01)

(58) Field of Classification Search
USPC ..... 42/115, 116, 120, 121, 134, 135, 136, 42/137; 33/227, 228, 286; 89/200
See application file for complete search history.

(56) References Cited

U.S. PATENT DOCUMENTS

| | | | |
|---|---|---|---|
| 5,118,186 | A | 6/1992 | Schrätzenstaller et al. |
| 7,523,582 | B1 | 4/2009 | Ahrens et al. |
| 2005/0278964 | A1 | 12/2005 | Minica et al. |
| 2008/0276473 | A1 | 11/2008 | Raschella et al. |

SET FOR POSITIONING AND ALIGNING A DISRUPTOR FOR THE DEACTIVATION OF A TARGET

RELATED APPLICATION

This application is a divisional patent application of U.S. patent application Ser. No. 14/053,998 filed Oct. 15, 2013, which claims benefit of priority to French Patent Application No. 1259865, filed Oct. 16, 2012, the entirety of which is hereby incorporated by reference.

BACKGROUND

1. Technical Field

The field of the invention is that of the implementation of deactivating guns, also called disruptors, adapted to deactivate explosive devices or other apparatuses. The invention is more particularly directed to enabling pointing (positioning and aligning) of such a disruptor with high accuracy while combining rapidity and simplicity of implementation.

2. Description of the Related Art

An example of a deactivating gun is described in Great Britain Pat. No. GB-2 224 102A; it comprises a base on which a gun is mounted with various possibilities of adjustment, in height and in elevation angle. The assembly is positioned near its target and the gun is manually pointed towards that target by an operator; no accessory is provided to facilitate that pointing.

U.S. Pat. No. 5,118,186 discloses a method and a device for adjusting an aiming device in weapons systems. An aiming telescope is fastened to the barrel of a weapon, as well as a laser range-finder which is attached to that telescope. A collimation line comprises a laser source fitted into the barrel of the weapon so as to be coaxial with the barrel, as well as a collimator defining a focal plane; the laser source combined with that collimator enables a reference mark to be formed in a film situated in the focal plane. A reference reticle linked to the aiming telescope is set using the range finder so as to ensure that the aiming of the aiming telescope corresponds to the firing line of the barrel. Such a configuration is complex due to the fact that the aiming axis is not coaxial with the barrel axis. It can be understood in fact from this document that it considers configurations in which the firing device is disposed far from its target.

U.S. Pat. Pub. No. 2005/0278964 discloses a laser integrated into the head of an arrow, which eliminates any problem of parallax between the arrow and the aiming laser, but means that the laser is lost after sending the arrow; another option is to provide an aiming laser close to the arrow, but a parallax offset, small but not zero, is then present again.

U.S. Pat. No. 4,777,754 teaches the mounting on a weapon of an optical unit of which the axis is slightly offset from that of the barrel, which, using a narrow beam, enables the point aimed at to be designated and using a broad beam enables the zone be to illuminated. However the fact that the optical aiming axis and the axis of the weapon are not coaxial has the drawback of giving rise to a certain firing error; furthermore, the orientation of the firing is not defined and does not therefore enable the angle of attack on the target to be controlled.

U.S. Pat. Pub. No. 2008/0276473 teaches the implementation of two laser diodes attached to a disruptor. These generate two crossed laser planes which project a cross onto the target whatever its distance from the disruptor. The disruptor is thus oriented so as to make that cross coincide with a point aimed at on the target. This solution does not define an aiming axis but only an arrival point for the projectile on the target. It does not therefore enable the angle of attack to be controlled. Moreover, it does not enable the disruptor to be brought into contact with the target since it would then no longer be possible to see the laser planes.

U.S. Pat. No. 7,523,582 discloses an accurate laser aiming system for a disruptor which is adapted to destroy a potential explosive device. This system is adapted to be interposed between the disruptor and its target; it comprises a base comprising two laser sources mounted back-to-back, along a common axis; that base is provided with components for position and orientation adjustment and a holed screen centered on the common axes of the laser sources and oriented rearward of the base, perpendicularly to that common axis; a mirror is furthermore provided to be fastened to the front of the disruptor, perpendicularly to its axis. The disruptor is first of all pointed as best as can be managed towards the target; the base is next positioned and oriented, in front of the disruptor, such that the front laser is positioned and oriented towards the target while the back laser intercepts the center of the mirror; if it appears that the beam sent back by the mirror fastened to the front of the disruptor is not sent back to the center of the screen, which means that the disruptor has not yet been correctly pointed, the position and orientation of the disruptor is next adjusted such that the mirror sends back the beam of the rear laser towards the center of the holed screen; it may prove necessary, by iterations, to re-position and realign the device according to the disruptor's displacement in terms of position and orientation. This device must be removed before triggering firing of the disruptor, whereas the mirror is generally left in place so as not to risk modifying the disruptor's configuration by removing it.

Such a system enables good co-linearity between the aiming accessory and the disruptor, subject nevertheless to the two lasers themselves being properly co-linear, which is generally rarely achieved with precision; furthermore, it has the drawback of requiring adjustment through iterations, which may prove difficult to implement; moreover, the requirement to position the device between the disruptor and its target has the drawback of preventing the disruptor being brought close to its target, which may adversely affect the effectiveness of the disruptor, in particular in case of a shaped charge. More particularly, the fact of placing the device with the laser sources between the disruptor and the target has two notable drawbacks. The first is to limit the accuracy of angular alignment of the laser axes since the setting errors will be all the more apparent the shorter the lever arm (unless the disruptor is disposed at a great distance from its target, which is generally not desired). The second is to prevent the disruptor and the target being brought closer together than a value fixed by the bulk of the lasers and the space necessary for the adjustments, which may compromise the effectiveness of the deactivation where, for example, a shaped charge is employed. Furthermore, the fact that the aligning mirror attached to the disruptor is destroyed by the projectile coming out therefrom generates a risk of modifying the trajectory of the projectile; furthermore, on breaking the mirror generates shards from which protection is required, complicating the use of the device all the more.

SUMMARY

A deactivating gun must be positioned and aligned to aim at a specific point of a device to destroy by controlling the angle of incidence of the projectile, for example a metal chisel or water projected at high velocity. In the case of an explosive device, its neutralization must in principle be carried out without making it explode, such that the pointing of the disruptor must be precise. Thus, the alignment/positioning must be at the same time accurate, rapid and simple, three criteria respectively imposed for reasons of effectiveness, safety and action under stress.

The disclosed subject matter aims to mitigate the drawbacks of the current solutions in a way that is simple, fast and of moderate cost, enabling accurate alignment of a disruptor relative to a target without requiring complex iterations, the disruptor being at a distance from the target which may be freely chosen by an operator; the disclosed subject matter is in particular directed to the case of a disruptor which is thus capable of being located in immediate proximity to a target for effective deactivation thereof, leading to a precious time-saving in emergency situations implied by the use of such a type of apparatus.

It should be noted here that, even when it is possible to bring a disruptor to a short distance from a target, it is still important to be able to point that disruptor with high accuracy; indeed, it may be necessary to localize the impact of firing by the disruptor on a volume of a few cubic centimeters only within the target to avoid the explosion thereof, that is to say on a much smaller volume than that of the target, at a significant distance from the envelope thereof; there is thus a need for accuracy, in position and in orientation, even when the disruptor is at its closest to that envelope.

It is to be recalled that the localization of the volume to hit within the envelope of the target, and thus the direction and the position of the firing line, may be determined in advance on the basis of radiography showing, despite the protection constituted by the envelope, the content of the target, including the part to destroy.

To that end the disclosed subject matter provides a method of positioning and aligning a disruptor adapted for the deactivation of a target and comprising a firing axis, a desired firing direction in terms of position and orientation relative to that target having been determined in advance, the method comprising the steps of:

disposing a laser, adapted to emit beams along an aiming line, at a distance from the target such that the aiming line of the laser is coaxial with the desired firing direction, interposing the disruptor between the laser and the target, positioning and orienting the disruptor so as to make the firing axis thereof coaxial with the aiming line, by means of a flat mirror mounted at the rear of the disruptor and disposed perpendicularly to the axis of the disruptor to send back to the laser a beam which while being coaxial with that aiming line is emitted by the laser and reflected by the mirror onto a mark centered on the firing axis.

It will be understood, by comparison with the teaching of U.S. Pat. No. 7,523,582, that the disclosed subject matter teaches only to employ a single laser source, situated behind the disruptor relative to the target, such that the disrupter can be disposed very close to its target, while leaving the operator free to choose a large distance between the disruptor and the device, to maximize the pointing accuracy. In fact, relative to the teachings of the cited documents, the disclosed subject matter lies in particular in the fact of having realized that the fact of first of all disposing the laser in relation to the target (which may be carried out on the basis of radiography performed beforehand, in the case of an operation of deactivating a target), before any putting into place of the disruptor between that laser and the target, then enables adjustment (without iteration thereof) relative to the target which is both simple, accurate and fast.

Advantageously, the step of positioning and orienting the disruptor relative to the laser first of all consists of orienting the mirror (and the movable disruptor to which it is attached) so as to make it perpendicular to the aiming line of the laser, then of moving that assembly (mirror-disruptor) through translations (without change in orientation) such that the aiming line of the laser is intercepted by the mirror at the location of said mark. The fact of first of all adjusting the orientation then the position of the disruptor contributes to minimizing the needs for iterations during that adjustment.

In practice, the distance between the laser and the target is chosen according to needs, and in particular according to the size of the disruptor; this distance is in practice at least several tens of centimeters, for example one meter. Moreover, it can be understood that the fact of increasing this distance does not imply reducing the accuracy; on the contrary, the greater the distance between the laser and the disruptor, the better the accuracy of pointing of that disruptor relative to the laser, and thus relative to the target. In fact, the fact of disposing the movable disruptor in front of the laser makes it possible to choose the pointing accuracy (linked to the distance between the laser and the mirror) and the proximity of the disruptor in relation to the target to be chosen independently. A range of 2 to 5 meters would appear to be a good compromise for a deactivation.

Thus, according to an advantageous application of the disclosed subject matter, the disruptor is positioned such that the mirror which is attached thereto is closer to the target than the laser. Even if the i disclosed subject matter has particular advantages when the disruptor is positioned at less than a few meters from the target (typically up to three meters), it should be understood that the disclosed subject matter may be implemented at greater distances from the target.

For implementing this method, the disclosed subject matter provides a set for dismantling a target comprising a disruptor having a firing axis and a device for aligning and positioning the disruptor in a deactivation direction that is determined relative to the target, comprising a firing sub-set comprising a movable mounting on which is mounted a movable carriage to which the disruptor is fastened and which is provided with components for adjustment in translation and in orientation relative to the mounting and a mirror oriented rearward of the disruptor and fastened to the disruptor while being perpendicular to the firing axis while having a centering mark centered on that axis, and a pointing sub-set comprising another mounting on which is mounted a laser adapted to emit beams along an aiming line coaxial with the deactivation direction, the pointing sub-set being disposed behind the firing sub-set relative to a target such that the mirror intercepts the aiming line of the laser at its centering mark while being perpendicular thereto, whereby the firing axis of the disruptor is coaxial with the aiming line of the laser.

Advantageously, this set further comprises a viewing screen fastened to the laser in front of the laser, while having an axis of symmetry aligned with the aiming line of the laser, designed so as to view the point of strike with that screen, thanks to the scattering nature thereof, of a beam emitted by the laser and reflected by the mirror towards that screen. Viewing the strike of the reflected beam may be achieved on the front part of the actual laser itself. Nevertheless, the presence of such a screen makes it possible to choose the maximum acceptable angular offset between the emitted and reflected beams, and thus between the aiming line of the laser and the deactivation direction, at the beginning of the alignment operations independently of the size of the laser.

Particularly advantageously, the viewing screen has a surface oriented towards the firing sub-set which is not only scattering but also reflective, which makes it possible to increase the pointing accuracy.

Various shapes may be chosen for the screen, while having an axis of symmetry that is coaxial with the aiming line of the laser. The screen may thus be flat (reflective or not reflective); as a variant, the reflective surface of the screen is advantageously convex.

The mountings for the carriage or for the laser may be of very diverse types, such as mobile robots. Advantageously, the mounting for the carriage bearing the disruptor, or even the mounting for the laser, is a tripod comprising a platform and legs of which the respective angular sweeps relative to the platform are sufficiently great for the carriage (or the laser) to be below or above the platform, according to needs.

The laser advantageously emits in the visible range, which facilitates the location of the strikes on the mirror and on the laser (or on the viewing screen); nevertheless, according to a variant which may be advantageous in certain conditions, the laser may be designed to emit beams outside the visible range.

It is understood that the disclosed subject matter also relates to part of the aforementioned set, in particular, the firing sub-set combined with the reflective mirror. The disclosed subject matter thus also covers a pointing device for the positioning and aligning of a disruptor, comprising a mirror adapted to be fastened at the rear of a disruptor while being oriented rearward thereof and being perpendicular to the firing axis of the disruptor and having a centering mark centered on that axis, and a pointing sub-set comprising a mounting on which is mounted a laser adapted to emit beams along an aiming line and being adjustable in position and in orientation relative to that mounting (so as to enable the aiming line, at the time of a deactivating operation, to be coaxial with the desired direction of deactivation), the pointing sub-set being adapted to be disposed facing the mirror such that the mirror intercepts the aiming line at its centering mark while being perpendicular to it.

The advantageous features referred to above in relation to a possible viewing screen also apply here, when the pointing sub-set alone is considered, with the mirror (it may be reflective, or not, flat or convex).

DETAILED DESCRIPTION

The subject matter described below concerns the positioning and the orientation of a disruptor for the deactivation of a target.

The method of the disclosed subject matter may be summarized as follows. The operator defines the optimum orientation and position which the disruptor must have to be directed to the target. This direction referred to as deactivation direction is materialized using an optical beam, in particular a laser beam, along an aiming line. These operations of aligning and positioning the disruptor relative to the source of the optical beam then enable the aiming line to be made coaxial with the axis of the disruptor with a level of uncertainty of pointing-centering which is of the same order or magnitude as the size of the laser beam used; this uncertainty may be millimetric when the laser is of a millimetric dimension.

Figure 1:
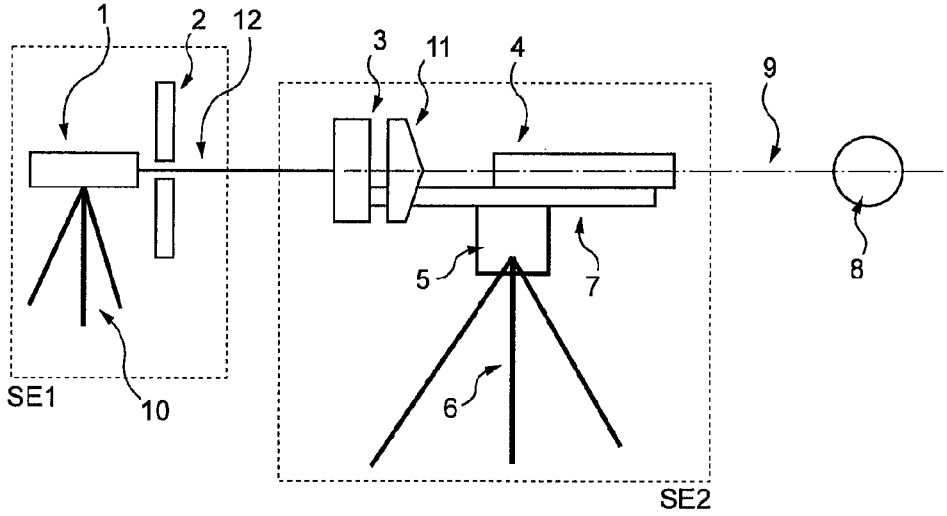
FIG. 1 is a synoptic diagram of a device for positioning and aligning a disruptor, combined with such a disruptor in accordance with an embodiment of the invention.

The principle of the disclosed subject matter is illustrated diagrammatically in FIG. 1, which represents a positioning and aligning device, together with a disruptor which it is sought to orient with precision relative to a target. This set is composed of two subsets designated by SE1 and SE2.

Sub-set SE1 is composed of an aligning laser 1 having an aiming line and which is mounted on a mounting 10, in practice placed on the ground, and with a viewing screen 2 situated in front of that laser, centered on the axis of that laser and disposed perpendicularly to it. This viewing screen is adapted to be passed through by a laser beam emitted by the laser 1, at least at its central portion (illustrated diagrammatically at a point A of FIG. 4); this central portion may be constituted by a bore or be a portion transparent to such a laser beam, and preferably furthermore be partially scattering; more particularly, the surface of the screen oriented towards the front is rendered scattering, by any appropriate known technique (for example sand blasting, screen printing or laser etching of a grid pattern), so as to be able to make visible the point of strike of a laser beam intercepting the screen, hence the name "viewing screen" (see below). In general terms, this sub-set SE1 is adjustable in position and in orientation relative to a target to deactivate; since it is possible for the positioning and the orientation of the mounting relative to the ground, and thus relative to the target, not to be freely chosen, it is preferable for the laser itself to be adjustable in position and in orientation relative to that mounting. According to needs and the surroundings, the mounting 10 may be a tripod, a robot or any other means.

In practice, the pointing of the laser may be carried out on the basis of radiography of the target carried out using a source of radiation carried by the same mounting as the laser; in this case, the position of the laser is determined by the position of the point source of the x-rays of the source and its orientation, which is the only one capable of adjustment, is defined to meet a point identified within the target by means of the radiography; a mechanical system then serves to orient the laser around the center of emission of the source which then serves as a mounting for the laser.

sub-set SE2 comprises a disruptor 4, known per se, mounted on a carriage 7 connected to a mounting 6 resting on the ground by mechanical members 5 for adjustment in translation and in rotation. This sub-set further comprises a flat centering mirror 3 fastened to the disruptor, mounted and disposed so as to be centered on the axis of the disruptor (that is to say on its firing axis) perpendicularly thereto, towards the rear, that is to say away from the firing line. The surface of the centering mirror 3 is preferably rendered both reflective and scattering by any suitable method (for example sand blasting, screen printing or laser etching of a grid pattern), so as to be able to reflect a laser beam intercepted by the mirror while viewing the point of strike.

This mirror comprises a mark of any appropriate nature enabling the center O to be viewed. it may be a cross or a mark having a scattering capability greater than the rest of the surface of the mirror; in FIG. 3 below, this mirror 3 comprises two reference axes, which are preferably perpendicular, and of which the crossing marks the center of the mirror; locating lines may furthermore be formed on the mirror, the purpose of which will become apparent below. This mirror here is disk-shaped but may be of any other appropriate shape, for example polygonal.

The mounting of the mirror at the rear of the disruptor is advantageously carried out via a member for fastening the disruptor to the carriage or via the carriage itself; more specifically, the mirror is preferably produced from metal and may then profit from the mechanical accuracy of machining that is easily available to enable the mirror to be positioned with sufficient accuracy, to the nearest tenth of a millimeter or to the nearest tenth of a milliradian, relative to the disruptor via the member for fastening the disruptor to the carriage and the carriage itself.

Advantageously, this sub-set further comprises, in front of the mirror but rearward of the exit from the disruptor, a shard shield 11 adapted to protect the mirror, in case of need, from possible shards resulting from the utilization of the disruptor. However, such a member is not always useful; thus, the disruptor may be of the "recoilless" type, which ejects a certain quantity of water rearward to balance the recoil. The only rearward projections are then water at high velocity with fragments of plastic coming from the plugs of the disruptor serving to contain the water prior to firing. Such disruptors are normally equipped with deflectors to break up those jets such that a shard shield is normally not needed. The centering mirror 3 may be produced from material that is shock-resistant and resistant to the projections resulting from the firing of the disruptor, such as a metal like aluminum or a stainless steel for example. The shard shield 11, if present, protects the centering mirror 3 from the projections of water or various particles coming from the disruptor at the time of firing. It may be produced from the same material as the mirror 3. It may be wedge-shaped or conical in order to deflect the projections laterally or radially, respectively.

The sub-set SE1 is disposed behind the sub-set SE2 relative to a target reference 8, at any suitable distance chosen by the operator. The location of SE1 gives rise to no constraint as to the location of SE2, which may thus be as close to the target as the operator wishes.

The positioning and aligning device, per se, comprises essentially the components 1 to 3, the mounting 6 and the components 5 for adjustment in rotation and in translation of the carriage 7 which are capable of being used independently of the positioning and aligning device.

It is understood that, when these components are perfectly co-axial, a laser beam emitted by the laser 1, which passes through the screen 2 at its center, is intercepted by the mirror at its center and is sent back to the center of the screen and thus to the laser 1. Since the mirror is mounted so as to be coaxial with the disruptor, this means that, in this configuration, the axis of the laser 1 is coaxial with the axis of the disruptor.

The alignment laser 1 produces a beam 12 along an aiming line which materializes the desired firing direction 9 (deactivation direction), defined in advance by the operator, along which a shot by the disruptor must hit the target 8, with a certain orientation, to achieve the deactivation thereof. The viewing screen 2 is attached to the laser 1 and is passed through by the beam 12; as will be detailed later it enables the quality of the self-collimation of the alignment to be viewed.

Sub-group SE2 serves to position the disruptor 4 relative to the laser so as to make the firing axis thereof coaxial with the aiming line, and thus with the desired firing axis 9, by taking advantage of the fact that this axis of the disruptor 4 is, through the construction of the set, mechanically coaxial with the axis passing via the center of the centering mirror 3 and perpendicular to its reflective surface.

Alignment Operations

The operations for implementing the aligning device are diagrammatically represented by FIGS. 2 to 6 and comprise:

an operation of positioning and aligning the aligning laser (sub-set SE1) with the target, an operation of aligning the disruptor relative to the sub-set SE1, after fastening the mirror 3 to the disruptor, to make the respective axes of those sub-sets parallel, an operation of positioning the disruptor relative to the sub-set SE1, to make those respective axes coaxial.

The desired firing axis (9), referred to above as the deactivation direction, is defined in advance by the operator using any suitable method to hit the target (8) with a certain orientation by the firing of the disruptor (4); as indicated above, this determination in advance may be carried out by means of radiography by means of a source mounted on a mounting on which the laser is also mounted. In principle, the definition of the desired firing axis does not need to take into account the laws of ballistics, provided the disruptor is sufficiently close to the target for it to be considered that the firing will be taut (that is to say along a rectilinear trajectory).

To start with, the sub-set SE1 is put into place, that is to say that the laser 1 equipped with its viewing screen 2 is put in place on the mounting 10 near the target. A sufficient distance between the set SE1 and the target must nevertheless be provided so as to be able to interpose the sub-set SE2 subsequently. Of course, the set SE1 may be assembled in advance (in particular in combination with a source of radiation as indicated above).

The distance at which the sub-set SE1 is placed relative to the target depends on the nature of the target to destroy, on the type of firing to perform with the disruptor and on the conditions for optimum effectiveness of the disruptor; this distance is preferably comprised between 2 and 5 m according to the bulk of the disruptor used for example or according to the constraints specific to the radiography carried out prior to that neutralization.

Figure 2:
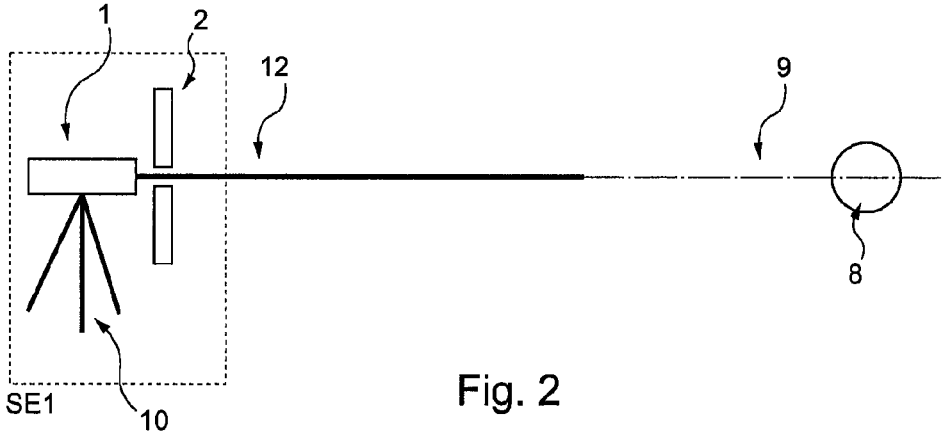
FIG. 2 is a synoptic diagram of a first sub-set of that device in a first step of the method of positioning and aligning the disruptor.

The laser 1 is then aligned using any suitable method, by action on the components for adjustment of the mounting 10, with a point identified in advance within the target 8 (termed point of interest) to hit by the disruptor along the aiming line 9, as indicated in FIG. 2.

The sub-set SE2 is next interposed between the sub-set SE1 and the target while ensuring the greatest possible distance between the screen 2 and the centering mirror 3 to minimize the uncertainty in the alignment; the disruptor may however by disposed as close to the target as the operator wishes. The initial positioning of the disruptor is carried out visually by the operator such that the disruptor points approximately at the point of interest of the target and such that the alignment laser hits approximately the center of the centering mirror 3. This is illustrated diagrammatically by FIG. 3.

Figure 4:
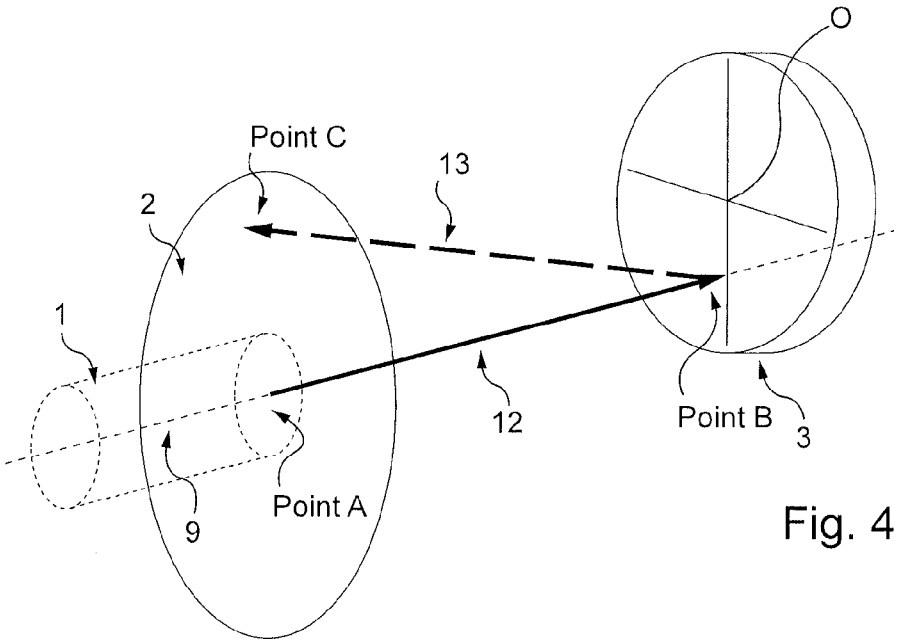
FIG. 4 is a synoptic diagram of the use of a screen comprised by the first sub-set and of a mirror mounted on the disruptor for that second step.
Figure 5:
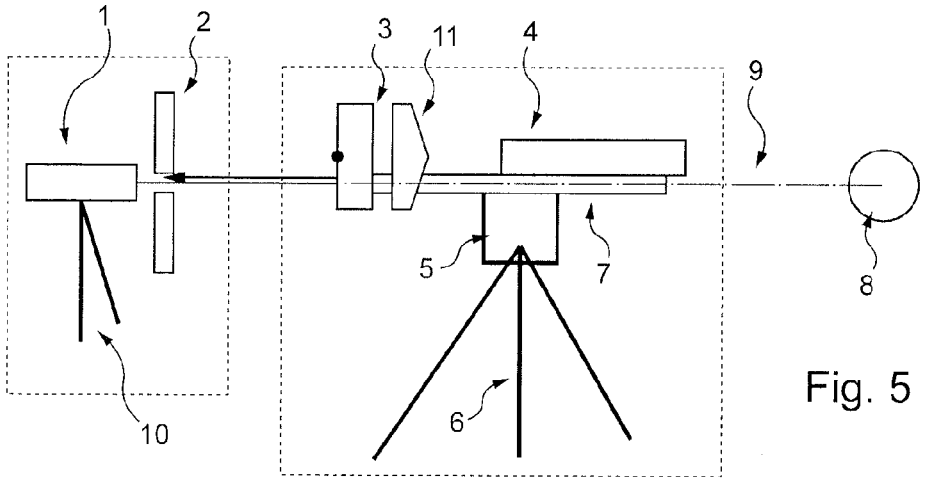
FIG. 5 is a synoptic diagram of a first part of that second step.
Figure 6:
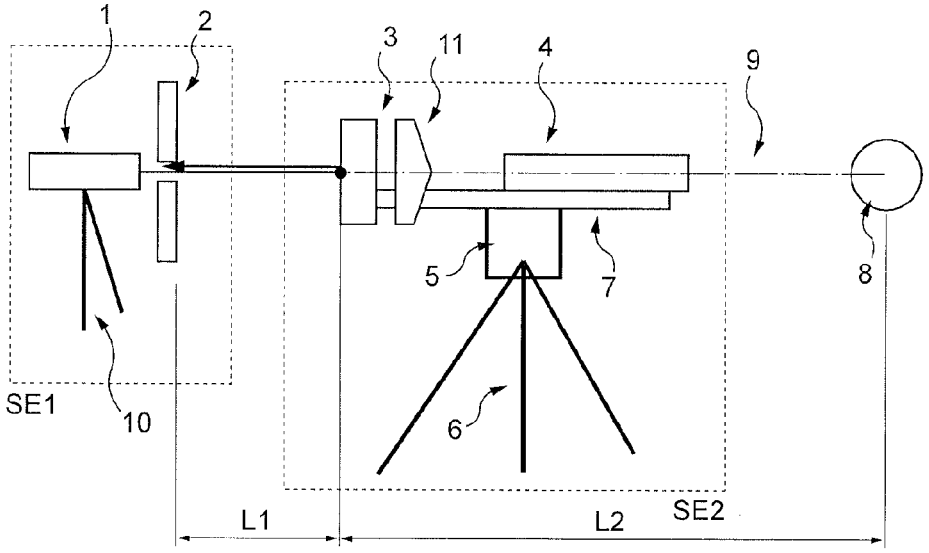
FIG. 6 is a synoptic diagram of a second part of that second step.

FIG. 4 shows the principle of the fine alignment used by the disclosed subject matter, utilizing the viewing screen 2 and the centering mirror 3.

The laser beam 12 emitted by the laser 1 through the screen 2 at point A, is reflected by the centering mirror (3) attached to the disruptor, at a point denoted B. The reflected laser beam 13 meets the screen 2 attached to the laser at a point denoted C; the surface of the screen 2 is solely scattering here (without any significant capability to reflect the beam); however, the back face of the centering mirror 3 is advantageously both scattering and reflective, whereby the laser beam 12 is not only reflected to form the reflected beam 13 but also scattered in order to make the reflection point B visible. At the start of the operations of positioning and aligning the disruptor, point B is generally remote from the center O of the centering mirror 3.

A first aligning step consists of making the axis of the centering mirror 3 collinear with the laser beam 12. For this, the procedure adopted is as follows: To start with, the axis of the mirror is rendered parallel to the laser beam by the self-collimation method, that is to say by rotations of the mirror 3 (and thus of the disruptor) until the point C is brought to the point A. To that end, micrometric screws for rotation are for example used, which are installed in the rotation-translation system 5 linking the disruptor to its mounting 6. The result obtained is presented in FIG. 5. The mirror is then perpendicular to the laser beam 12 emitted by the laser 1.

The aim is next to center the mirror on the laser axis, by translating the mirror until its center, which is materialized, is brought to point B. To that end, micrometric screws for translation are for example used, which are installed in the aforementioned rotation-translation system 5. As this adjustment does not modify the previous adjustment in terms of rotation, the self-collimation is preserved. The result is presented in FIG. 6 (for reasons of clarity, the reflected beam is represented slightly offset relative to the emitted beam).

The adjustment have then been terminated and the disruptor is ready to be employed. To be precise, after the adjustments in terms of rotation and then in translation, the axis of the centering mirror 3 is coaxial with the axis of the laser 12 materializing the firing line 9. As the axis of the disruptor is coaxial with that of the centering mirror, it is thus also coaxial with the firing line 9, which corresponds to the result sought.

Figure 3:
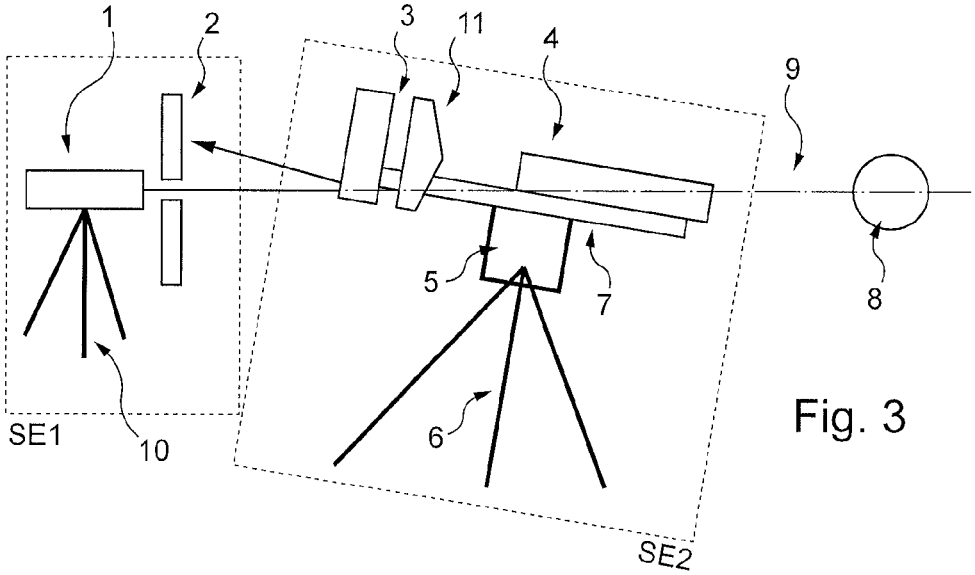
FIG. 3 is a synoptic diagram of that device in a second step of the method of positioning and aligning the disruptor.

The viewing screen is represented here as being a separate part from the laser 1; as a variant, it is materialized by a front face thereof if its surface area is sufficiently great to be intercepted by the reflected beam in the configuration of FIG. 3 and if its surface state enables viewing of the strike of that reflected beam.

Evaluation of the Alignment Accuracy

It may be noted that the alignment so attained is of very high quality.

The following notations may be used:

Δc is the error which may be made in the centering of the beam 12 on the centering mirror 3 at point B, Δp is the error which may be made in the centering of the reflected beam 12 on the screen 2 at point C, L1 is the distance between the screen 2 and the centering mirror 3 and L2 is that between the latter and the target.

The angular error Δa may be written in the form:

$$\Delta a = \frac{\Delta p}{2L_1}$$

By virtue of the optical principle of this device, the angular error is divided by a factor of 2 which is due to the reflection in the centering mirror and is divided by the distance L1. As a matter of fact, L1 serves to scale down the angular error by separating the return, point C, from the incident beam, point A.

Let E be the aiming error of the disruptor or the distance between the point aimed at by the disruptor after alignment and the target. This error E may be written in the form:

$$E = \Delta c + L_2 \frac{\Delta p}{2L_1}$$

By taking realistic values such as Δc=1 mm, Δp=1 mm, L1=2 m and L2=1 m (the drawings are not to scale, for reasons of clarity), an aiming error is obtained of E=1.25 mm.

The firing accuracy will be all the more satisfactory if the projectile has no physical barrier to pass through before hitting the target and if there is no risk of it being deviated.

Furthermore, no modification is made between the termination of the alignment and the firing (for example such as the removal of a mirror, since the mirror in no way hinders the firing), which is a guarantee of stability of the alignment.

It is thus verified that the device of the disclosed subject matter, constituted by the constituents 1+2+3 enables accurate and rapid alignment of the aiming axis of the disruptor in terms of position and angle, without iterative steps. It furthermore enables the disruptor to be brought practically into contact with the target, if necessary.

This device thus makes it possible, reliably and simply, to coincide the axis of a disruptor, or of another apparatus, with a laser beam oriented in advance using any suitable method.

Exemplary Embodiment

Figure 7:
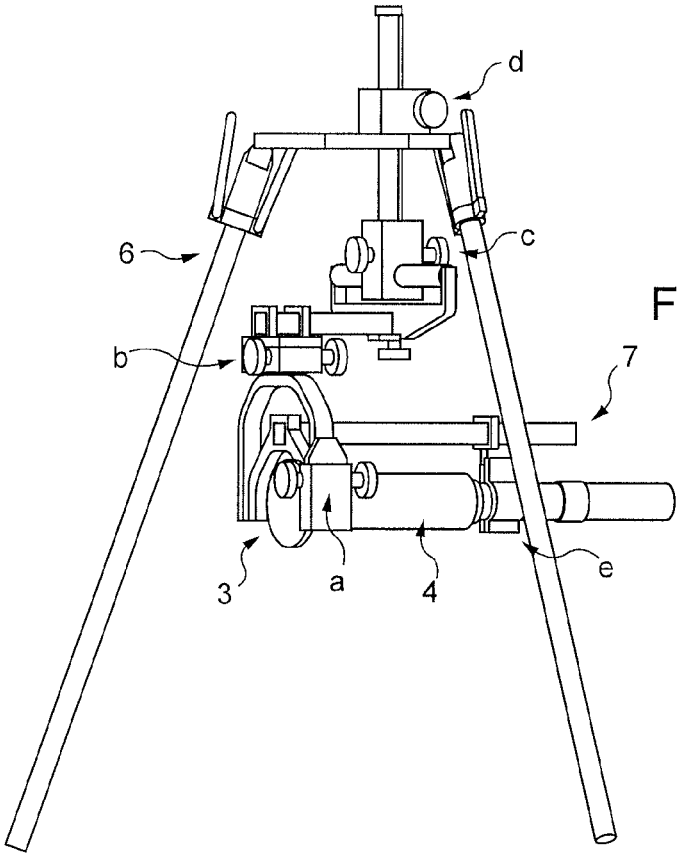
FIG. 7 is a diagram of an example embodiment of a disruptor provided with the mirror.

FIG. 7 shows a preferred example embodiment of the sub-set SE2.

The disruptor 4 may, of itself, be any suitable model. It may for example be a disruptor known under the designation recoilless Richmond RE70 (case represented in FIG. 7); disruptors known under the designation Neutrex 12.7 and 20 mm, whether or not recoilless, may also be cited.

The reference "e" designates the components that are conventional per se enabling the disruptor to be interfaced with the rest of the device via the carriage 7. The centering mirror 3 placed at the rear of the disruptor is supported by the carriage 7 such that its axis is coaxial with that of the disruptor.

The components for adjustment of the carriage in rotation and in translation relative to the mounting 6, here formed by a tripod, advantageously comprise separate assemblies for the various adjustments.

Reference "a" designates a device for adjustment of the carriage 7 in terms of rotation around a horizontal axis; this device is constituted here by knobs actuating a worm-and-pinion system. It enables the nose-down or nose-up adjustment, also referred to as elevation adjustment, of the carriage 7.

The reference "b" designates a device for rotational adjustment around a vertical axis, which may comprise similar components to those of the device a. This device makes it possible to adjust the right-left orientation, or azimuth adjustment, of the above assembly.

The reference "c" designates a device for adjustment in horizontal translation while the reference "d" designates a device for adjustment in vertical translation. These devices c and d are constituted here by a rack-worm system and knobs. They enable the adjustment of the horizontal and vertical offsets, respectively, of the assembly described above.

In the example represented, the rotational axes of the rotational adjustment devices are co-planar. it is even advantageous for these axes to cross at the location of the mark on the mirror. In such a case, the order of the adjustments may be arbitrary since the rotations do not lead to movement of that mark relative to the laser beam. When the aforementioned rotational axes do not meet the aforementioned conditions, it is recommended to begin with the rotations and then to perform the translations (otherwise it may prove necessary to perform iterations). The fact of providing to start with the rotational adjustments before the translational adjustments has the advantage of avoiding iterations independently of the specific configuration of the rotational axes relative to the mirror. It may however be understood that, if it is accepted to perform a limited number of iterations, the order of the adjustment operations may be freely chosen.

The fact of disposing the rotational adjustment devices between the disruptor and the translational adjustment devices, which in practice amounts to displacing the disruptor away from the central part (platform) of the mounting 6, may have the advantage of minimizing the risk of the legs of that mounting getting in the way of the rotational adjustment operations of the disruptor especially when the center of those rotations is situated on the mirror, that is to say considerably offset in relation to the center of gravity of the disruptor.

The tripod here which here is a constituent of the mounting advantageously comprises legs that are adjustable in orientation relative to the platform to which the components for translational and rotational adjustment are connected, with sufficiently great sweep for the assembly of the carriage and the components for translational and rotational adjustment to be either below (configuration represented in FIG. 7) or above the platform, according to need. The configuration represented has the advantage that the assembly 4+7 is suspended under the platform, which enables very low firing lines with the possibility of bringing the disruptor to within a few centimeters of the ground and ensures good stability of the assembly; the other configuration has the advantage of enabling the disruptor to be disposed at much greater heights, without risking hindrance by the legs of the maneuvers of the devices for translational and rotational adjustment.

The ends of the legs are advantageously provided with members facilitating anchorage to the ground; they may, in particular, be non-slip tips or spikes enabling anchorage into the ground.

By way of an example embodiment, the centering mirror is produced from stainless steel, covered with a layer of aluminum and with a layer that is protective against oxidation; this mirror is of 120 mm diameter and 20 mm thickness, and the protective layer is in accordance with the standard procedures in the field of mirrors of glass-aluminum in optics. The reflective and scattering aspect of the mirror surface is for example achieved by means of a grid formation of orthogonal lines etched by laser to a small depth, typically of the order of a few microns; as a variant, the reflective and scattering aspect of the mirror surface may be acquired by grinding, after polishing, so as to create micro-scratches over the whole of the surface.

When the firing line that is desired relative to the target has been determined independently, the sub-set SE1 may have a similar structure to that of sub-set SE2, the only difference being that the disruptor is replaced by the laser 1. However, as indicated above, the sub-set SE1 may comprise, as mounting for the laser, a radiography set comprising a mounting and an x-ray source; the laser is then advantageously mounted on that source or its mounting such that its aiming line passes via the center of emission of that radiation source. The mounting for the radiography set may be a simple tripod set up approximately relative to the target, without translational adjustment. when the firing line enabling the zone to be hit within the target has been determined, it suffices, by simple rotational adjustment, to orient the laser such that its aiming line intercepts the zone to be hit. The adjustment of the laser relative to the mounting can only be made rotationally. Other types of mounting are of course possible, for example of the robot type; in fact, the disclosed embodiment does not relate to the manner in which the laser is pointed towards the target.

The laser for example has a wavelength in the visible range; it may be red, but the choice of a wavelength in the green range, for example 526 nm has the advantage of enabling easier detection by the human eye, including in the case of certain forms of color blindness. Numerous lasers are available on the market with such a wavelength.

By way of example, the viewing screen, which here is merely a scattering screen, may be produced from paper or white card, of scattering plastic or of any other material covered with white paint; there are numerous products of this type on the market.

It may be noted that the sub-set represented in FIG. 7 does not comprise any shard shield such as that represented diagrammatically under the reference 11 in the preceding Figures; indeed, it was explained that such a screen is not necessary and is merely optional.

It was indicated with regard to the viewing screen that it had a front surface (oriented towards the disruptor) having only scattering properties to enable easy viewing of a strike of the beam reflected by the centering mirror; advantageously, this front surface furthermore has reflective properties, the advantage of which is to enable optimization of the alignment.

Figure 8:
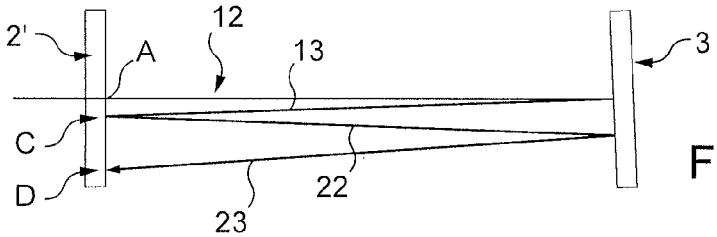
FIG. 8 is a synoptic diagram of a variant of the configuration of FIG. 4.

FIG. 8 thus shows that the viewing screen 2' at C sends back the beam coming from the mirror 3; this beam, denoted 22, is in turn reflected by the centering mirror as a beam 23 which intercepts the screen 2' at a point D. it can be understood that at each reflection, the possible angular error between the axes of the members 2' and 3 is amplified; at D, the beam, having undergone three reflections, is three times further from A than point C, whereby three times better accuracy is given in the evaluation of the angular offset between the axes and members 2' and 3. The more reflections there are, the higher the accuracy; assuming the maximum number of reflections before extinction (or the sending of the beam off the viewing screen) is ten, this method improves the angular accuracy by a factor of ten.

The angular error Δa in fact becomes:

$$\Delta a = \frac{\Delta p}{NL_1}$$

N being the number of reflections used.

The preceding explanations were given in a case in which both the centering mirror and the viewing screen are flat.

It can be understood that the greater their transverse dimensions, the less it is necessary for the first adjustment of the disruptor configuration to be precise (see FIG. 3); by contrast, the smaller those dimensions, the smaller the bulk and the weight, and the easier it is to bring the disruptor close to the ground.

Figure 9:
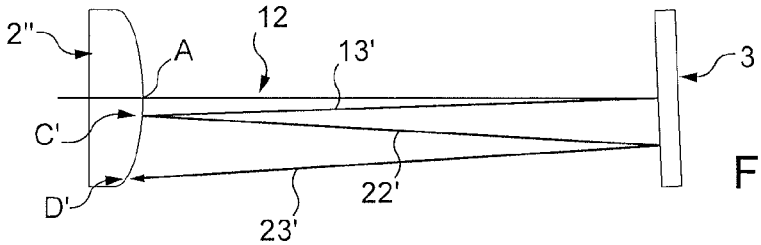
FIG. 9 is a synoptic diagram of another variant of the configuration of FIG. 4.

In fact, the viewing screen may be not flat but have a convex shape (preferably with an axis of symmetry coaxial with the axis of the laser). FIG. 9 thus shows that, with a convex screen denoted 2", the further the beam reflected by the mirror intercepts the screen from point A, the more the beam 22' reflected at C' deviates from the axis of the laser, and the further the point D' at which the beam 23' sent back by the mirror is away from point A. The accuracy is all the more improved.

Moreover, the preceding explanations have been given with regard to a laser beam of very small diameter (of the order of the millimeter) so as to intercept the mirror, then the viewing screen, at points that are easy to locate. As a variant, the beam is widened, so as to have parallel or slightly diverging rays or on the contrary converging, in particular in the case of large distances between the laser and the disruptor.

Furthermore, the laser may be chosen, or complemented, such that the beam leaving the sub-set SE1 is outside the visible range (for example in case of firing in a context in which it is desired to remain discreet, or when the environment is too bright to the extent of preventing sufficient contrast from being obtained. it then suffices to provide the operator with a device enabling him to locate the strike on the viewing screen.

The invention claimed is:

1. A set for dismantling a target comprising:

a disruptor having a firing axis and a device for aligning and positioning the disruptor in a deactivation direction that is determined relative to the target, the set comprising:

a firing sub-set comprising:

a movable mounting mounted to a movable carriage the movable carriage having the disruptor fastened thereto and includes components for adjustment of the disruptor in translation and in orientation relative to the movable mounting; and a mirror fastened to the disruptor and oriented on an opposite side of the disruptor relative to the target and perpendicular to the firing axis, the mirror having a centering mark centered on the firing axis; and a pointing sub-set comprising:

a mount on which a laser is mounted, the laser adapted to emit beams along an aiming line coaxial with the deactivation direction, the pointing sub-set disposed opposite the firing sub-set relative to the target, such that the mirror intercepts the aiming line of the laser at the centering mark and is perpendicular thereto, whereby the firing axis of the disruptor is coaxial with the aiming line of the laser.

2. The set according to claim 1, further comprising a viewing screen fastened to the laser on a side proximate to the firing sub-set, and having an axis of symmetry aligned with the aiming line of the laser, the viewing screen configured so as to view a point of strike with the viewing screen of a reflected beam emitted by the laser and reflected by the mirror towards the viewing screen.

3. The set according to claim 2, wherein the viewing screen comprises a flat surface.

4. The set according to claim 2, wherein the viewing screen has a scattering and reflective surface oriented towards the firing sub-set.

5. The set according to claim 4, wherein the scattering and reflective surface of the viewing screen comprises a convex surface.

6. The set according to claim 1, wherein the movable mounting comprises a tripod including a platform and legs, wherein the legs sweep an angle relative to the platform that is sufficiently large for the movable carriage to be positioned below or above the platform.

7. The set according to claim 1, wherein the laser is configured to emit laser beams in a visible light range.

8. A pointing device for the positioning and aligning a disruptor, the device comprising:

a mirror fastened to the disruptor and oriented rearward thereof and perpendicular to a firing axis of the disruptor, the mirror having a centering mark centered on the firing axis; and a pointing sub-set comprising a mount having a laser mounted thereto that emits beams along an aiming line, the laser being adjustable in position and in orientation relative to the mount, the pointing sub-set disposed facing the mirror, such that the mirror intercepts the aiming line at its centering mark and is perpendicular to the aiming line.

9. The device according to claim 8, further comprising a viewing screen fastened to the laser on a side toward the mirror and having an axis of symmetry aligned with the aiming line of the laser, the viewing screen configured to view a strike point of a reflected beam emitted by the laser and reflected by the mirror towards the viewing screen.

10. The device according to claim 9, wherein the viewing screen comprises a flat surface.

11. The device according to claim 9, wherein the viewing screen has a reflective surface oriented towards the firing sub-set.

12. The device according to claim 11, wherein the reflective surface of the viewing screen comprises a convex surface.

* * * * *